United States Patent [19]

Inoue et al.

[11] 4,051,001

[45] Sept. 27, 1977

[54] PROCESS FOR REGENERATING ETCHING SOLUTION

[75] Inventors: Hajime Inoue, Kamakura; Fumio Harada, Yokohama; Kazunobu Kato, Yokohama; Syoji Oikawa, Yokohama, all of Japan

[73] Assignee: Hitachi, Ltd., Japan

[21] Appl. No.: 607,037

[22] Filed: Aug. 22, 1975

[30] Foreign Application Priority Data

Aug. 26, 1974 Japan ..... 49-97098

[51] Int. Cl.[2] ..... C25F 7/02

[52] U.S. Cl. ..... 204/151; 204/107; 204/130

[58] Field of Search ..... 204/130, 151, 149, 106, 204/107, 108, 128, 94, 95; 156/19

[56] References Cited

U.S. PATENT DOCUMENTS

| | | | |
|---|---|---|---|
| 2,748,071 | 5/1956 | Eisler | 204/130 X |
| 2,908,557 | 10/1959 | Black et al. | 156/19 |
| 2,964,453 | 12/1960 | Garn et al. | 204/130 |
| 3,373,113 | 3/1968 | Achenbach | 156/19 X |
| 3,400,027 | 9/1968 | Radimer et al. | 156/19 |
| 3,761,369 | 9/1973 | Tirrell | 204/151 |
| 3,788,915 | 1/1974 | Gulla | 204/130 X |
| 3,855,141 | 12/1974 | Ruff | 156/19 X |

*Primary Examiner*—Arthur C. Prescott
*Attorney, Agent, or Firm*—Craig & Antonelli

[57] ABSTRACT

After copper of printed circuit board lined with copper foil is etched with an acidic etching solution containing chloride ions, the resulting etching solution containing copper ions is placed in a cathode compartment partitioned with a diaphram from an anode compartment, while placing a caustic soda solution in the anode compartment, and subjected to electrolysis. In the cathode compartment, copper is deposited on an electrode without any redissolution of the deposited copper, and recovered, whereas in the anode compartment chlorine formed on an anode is absorbed into the caustic soda solution without any discharge to the atmosphere. The etching solution thus freed from the copper ions is admixed with the same kind of chemicals as consumed by the etching, and used again as a regenerated etching solution.

7 Claims, 2 Drawing Figures

PROCESS FOR REGENERATING ETCHING SOLUTION

BACKGROUND OF THE INVENTION

1. FIELD OF THE INVENTION

This invention relates to a process for regenerating an etching solution for printed circuit boards to be used in telecommunication appliances, etc., decoration boards, etc.

2. BRIEF DESCRIPTION OF THE PRIOR ART

In the production of printed circuit boards, there are available etching processes for removing unnecessary copper components by use of a solution containing ferric chloride, a solution containing ammonium persulfate, etc. The process by use of a solution containing ferric chloride is directed to dissolution of copper on the basis of conversion of trivalent iron ions ($Fe^{3+}$) in the solution to divalent iron ions ($Fe^{2+}$), but on account of coexistence of copper ions and iron ions in the solution, it is not easy to regenerate the used etching solution. Thus, the used etching solution is discarded, or especially handled by special dealers upon request. These are the disadvantages of said prior art process.

Since the iron ions and copper ions coexsisting in the solution have different electrodeposition voltages each other, it is reported that only copper can be efficiently recovered by adjusting a voltage between two electrodes, and also generation of chlorine gas can be suppressed (Japanese Patent Publication No. 6165/71). However, it is practically difficult to recover only copper without any generation of chlorine gas, and further more chlorine gas must be blown into the used etching solution to regenerate the solution. The chlorine gas is very toxic, and has a disadvantage of giving an unfavorable influence upon human bodies from the working side as well as environmental side.

On the other hand, the etching process by use of a solution containing ammonium persulfate has been widely used since soldering plating, etc. were employed for the production of printed circuit boards, but since the dissolved copper ions exist as complex salt in the solution, it is difficult to recover it as metallic copper, and furthermore the copper ions are kept in a dissolved state in the solution, unless the used etching solution is treated in a special manner, and thus the solution is still toxic and cannot be treated in the ordinary method for waste water treatment. These are disadvantages of said prior art process.

Another process for regenerating the etching solution used in the etching has been proposed, which comprises withdrawing a portion of the solution, while diluting the remaining solution to decrease metal ion concentration and adding hydrochloric acid or hydrogen peroxide thereto regenerate the used etching solution, but the proposed process fails to provide a cyclic regeneration system, and the withdrawn solution must be treated separately. These are the disadvantages of said another prior art process.

SUMMARY OF THE INVENTION

An object of the present invention is to provide a process for recovering copper ions dissolved in an acidic etching solution containing chloride ions therefrom without any generation of chlorine gas and continuously or discontinuously regenerating the etching solution freed from the copper ions without any injection of chlorine gas, that is, a process for regenerating an acidic etching solution containing chloride ions without any problem in sanitary safety and environmental safety.

Another object of the present invention is to provide a process for continuously or discontinously regenerating an acidic etching solution containing chloride ions with a good efficiency but without any redissolution of deposited copper when the copper ions dissolved in the etching solution are recovered therefrom to regenerate the etching solution.

The present invention is characterized by a process for regenerating an etching solution, which comprises effecting etching by use of an acidic etching solution containing chloride ions, recovering metal ions dissolved in the solution by etching as metal by diaphragm electrolysis, and regenerating the solution freed from the metal ions, thereby reusing it as an etching solution.

The acidic etching solution containing chloride ions used in the present invention contains no other metals than the metal dissolved by etching. For example, the etching solution contains no iron ions from ferric chloride, etc. in the etching of copper, and thus the dissolved metal ions can be readily recovered as metal from the etching solution used in the etching electrolysis.

In the present invention, the recovery of metal ions is carried out by diaphragm electrolysis, and thus the metal can be deposited on a cathode, whereas, if a liquid capable of absorbing chlorine gas, for example, a caustic soda solution, etc. is used at the anode side, generation of chlorine gas at the anode side can be prevented. Furthermore, the chlorine can be fixed at the anode side, and thus the metal deposited on the cathode is never redissolved.

The acidic etching solution containing chloride ions used in the present invention is an aqueous solution containing at least one of hydrochloric acid, inorganic acids or inorganic salts, or an aqueous solution further containing hydrogen peroxide.

For regeneration of the etching solution used in the present invention, hydrochloric acid, or other inorganic acid, and hydrogen peroxide, etc. are used, and it is not necessary to inject chlorine gas into the etching solution.

Since the present invention provides a cyclic system of electrolyzing the solution during the etching or after the etching by diaphragm electrolysis, thereby recovering metal ions as metal, and then regenerating the etching solution, and thus it is not necessary to withdraw a portion of the solution and treat it separately.

According to the present invention, etching, diaphragm electrolysis and regeneration of the solution can be carried out discontinuously and individually, or can be carried out continuously and successively or simultaneously.

Since a diaphragm is used in the present invention, chlorine can be fixed at the anode side, and consequently a rate of the electrolytic recovery can be accelerated.

DETAILED DESCRIPTION OF PREFERRED EMBODIMENTS

The present invention will be described below in detail, referring to examples.

EXAMPLE 1

Figure 1:
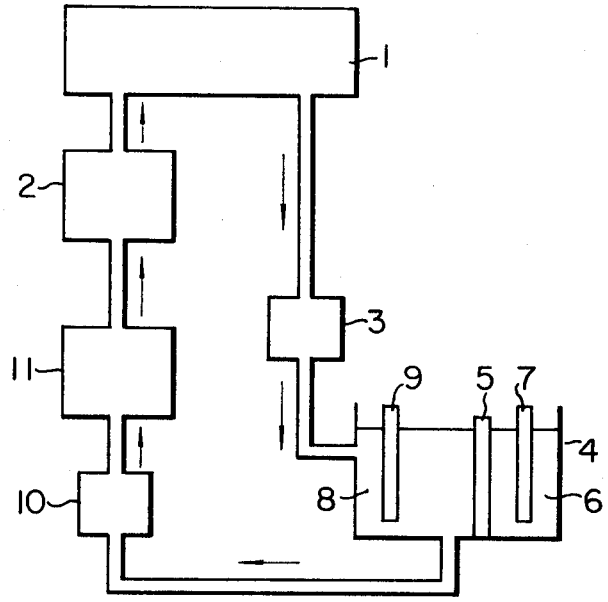
FIG. 1 is a block diagram showing one embodiment of an etching system used for the present process for regenerating the etching solution.

In FIG. 1, a block diagram of an etching system used for the present invention is shown, where a recycle route of the etching solution and an arrangement of apparatus is illustrated.

A material having a metal to be etched, that is, a laminate board having a size of 50 mm × 50 mm, lined with a 35 μ-thick copper foil, is placed in etching machine 1, and an etching solution is supplied to the machine to effect etching. The etching solution is stored in etching solution tank 2, and supplied to etching machine 1 therefrom.

An etching solution containing 130 ml/l of hydrochloric acid in 35% aqueous solution, 170 g/l of cupric chloride, and water to make 1l is stored in etching solution tank 2.

The etching solution is supplied to etching machine 1 at a rate of 1 l/min., to etch unnecessary portions of copper foil on said printed circuit board. Etching conditions are an etching solution temperature of 40° C and an etching time of 3 minutes.

After etching of 160 printed circuit boards having the size of 50 mm × 50 mm, a copper concentration of the etching solution becomes 1.5 moles/l, and an oxidation-reduction potential of the solution is reduced from 600 mV of the unused solution to 400 mV. When the oxidation-reduction potential of the solution reaches 400 mV, the etching solution is passed through filtration tank 3, where dusts suspended in the solution are removed by a polyester filter, which can be replaced with a titanium filter. Then, the etching solution is supplied to diaphragm electrolytic cell 4 at a rate of 10 l/min. Diaphragm electrolytic cell 4 is partitioned into two compartments by ceramic diaphragm 5 having a porosity of 40 to 50%, which can be replaced with an asbesto diaphragm. In anode compartment 6, 1 l of an aqueous 5% caustic soda solution is placed, and anode 7 is also disposed therein. As anode 7, an insoluble carbon electrode having a size of 50 mm × 150 mm × 2 mm is used. In another compartment of electrolytic cell 4, that is, cathode compartment 8, 2.5 l of the etching solution from filtration tank 3 after the etching is placed, and a cathode 9 is disposed therein.

To recover dissolved copper ions as metallic copper by electrolysis, a copper foil having a size of 50 mm × 100 mm × 0.03 mm is used as cathode 9. Electrolysis is carried out at a current density of 2 A/dm$^2$ for 6 hours to reduce the copper ion concentration of the solution to the concentration of the unused solution, that is, 170 g/l as cupric chloride. Then, the solution after the electrolysis is passed through filtration tank 10, where metallic scraps formed by the electrolysis or other foreign dusts are filtered off by a polyester filter, which can be replaced with a titanium filter, and supplied to regeneration tank 11 at a rate of 10 l/min.

In regeneration tank 11, reduced chloride is supplemented by adding 25 ml of hydrochloric acid thereto, and further 10 ml of hydrogen peroxide in aqueous solution is added thereto to convert $Cu^+$ to $Cu^{2+}$, thereby regenerating the solution. The regenerated solution is sent to etching solution tank 2, and etching is carried out again in etching machine 1 with the regenerated etching solution.

The copper deposited on electrode 9 by the electrolysis is recovered as copper material. The chlorine absorbed in the caustic soda solution in anode compartment 6 exists as sodium hypochlorite, and thus said solution can be used by cyanide treatment and sterilization of colitis germs in waste water treatment.

The etching, electrolysis and regeneration can be carried out at the same time and continuously.

EXAMPLE 2

Figure 2:
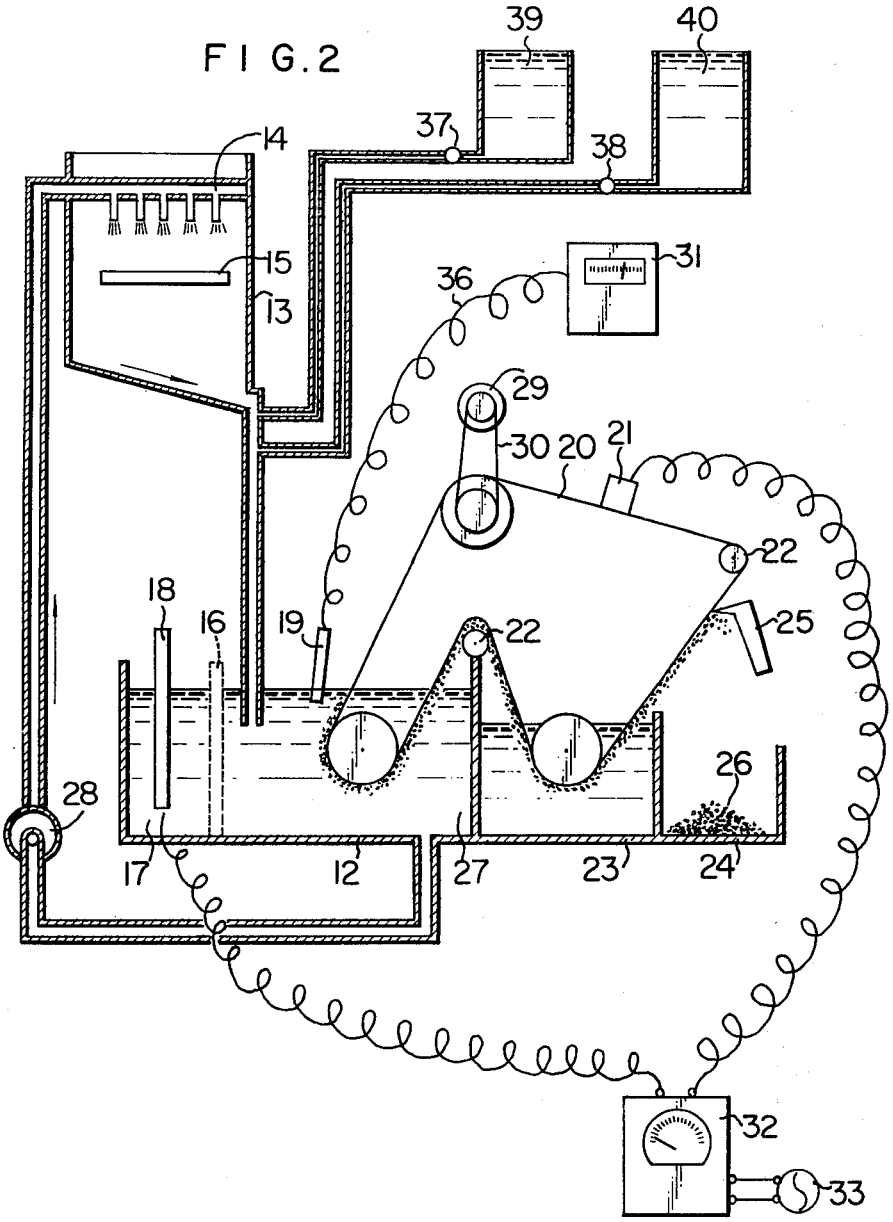
FIG. 2 is a schematic drawing showing another embodiment of an etching system for the present process for regenerating the etching solution.

In FIG. 2, a system of regenerating an etching solution according to the present invention is shown.

In etching solution tank 12, 500 l of an etching solution containing 100 ml/l of hydrochloric acid in 35% aqueous solution, 300 ml/l of sulfuric acid in 98% aqueous solution, 30 ml/l of hydrogen peroxide in aqueous solution and water to make 1 l is placed, and the etching solution is supplied to etching machine 13 by pump 28 at a rate of 30 l/min., and sprayed on a laminate board 15 bonded with a 35-μ thick copper foil by spray nozzle 14 to effect etching. Etching conditions are an etching solution temperature of 40° C and an etching time of 3 minutes. Etching solution tank 12 also serves as a cathode compartment of diaphragm electrolytic cell, and faces anode compartment 17 through diaphragm 16. Material of construction of etching solution tank 12 is polyvinyl chloride, which can be replaced with rubber-lined steel, Diaphragm 16 is a ceramic diaphragm having a porosity of 40 to 50%, which can be replaced with an asbesto diaphragm. In anode compartment 17, 200 l of an aqueous 5% caustic soda solution is placed, and anode 18 is disposed therein. As anode 18, an insoluble titanium electrode having a size of 800 mm × 1,000 mm × 3 mm is used, which can be replaced with platinum. Anode 18 is connected to a positive terminal of rectifier 32 through lead wire 34, and rectifier 32 is connected to electric source 33 of alternating current in 200 V. Metal ions in the etching solution placed in etching solution tank 12 are increased by etching the 35-μ thick copper foil on the printed circuit board having the size of 500 mm × 330 mm × 1.6 mm, and hydrogen peroxide therein is gradually consumed. The metal ion concentration is determined by colorimetry, and the hydrogen peroxide concentration is detected by oxidation-reduction potential electrode 19, and the detected current is led through electrode cord 36, and displayed in oxidation-reduction potentiometer 31. Oxidation-reduction potential electrode 19 is fixed to cathode compartment 27. The oxidation-reduction potential ensuring the etching is 400 mV or higher. When it is reduced to 400 mV, hydrogen peroxide is added thereto from aqueous hydrogen peroxide solution tank 40 at a flow rate of 4 l/hr. by adjusting valve 38. Consumed hydrochloric acid and sulfuric acid are supplemented by adding thereto an acid mixture consisting of hydrochloric acid and sulfuric acid in a proportion of the former to the latter of 7 : 1 by volume from acid mixture tank 39 at a flow rate of 0.5 l/hr. by adjusting valve 37. Concentrations of hydrogen peroxide, hydrochloric acid and sulfuric acid in the etching solution are thereby kept to the concentrations of unused etching solution, that is, the etching solution before the etching, and thus the etching solution can be always supplied in a stable state. The metal ions in the etching solution are deposited onto titanium belt 20 by reduction. That is, belt 20 functions as a cathode, and power source terminal 21 in contact with belt is connected to a negative terminal of rectifier 32. Current is passed from power source terminal 21 to rectifier 32 through lead wire 35. Belt 20 consists of stainless steel or titanium belt having a size of 500 mm × 5,000 mm × 2 mm, and rotates at a speed of 2 m/hr., 500 mm × 1,000 m × 2 mm of whose belt is dipped in the etching solution in cathode compartment 27. Belt 20 passes through cathode compartment 27 to water washing tank 23 while being held by guide rollers 22. The belt then passes over recover tank 24 and returns to cathode compartment 27 by rotation. Thus, the metal ions in the etching solution are deposited as metal onto belt 20 by electrolysis, and the metal on belt 20 is scraped off by scraper 25, and recovered as recovered metal 26 in recovery tank 24. The electrolysis is carried out at a current density of 20 A/dm$^2$ and an output current from rectifier 32 of 1,000 A at a voltage of 5 V.

As described above, the dissolved metal ions can be readily recovered as metal by electrolysis from the etching solution in the present invention, for no other metals than the metal to be dissolved by etching are used. Furthermore, on account of using a diaphragm electrolysis, no chlorine gas is generated at the cathode, and there is no fear of unfavorable influences upon human bodies.

According to the present invention, regeneration of the etching solution can be effected only by adding thereto hydrochloric acid or other inorganic acid, hydrogen peroxide, etc., and it is not necessary to inject toxic chlorine gas thereto. Thus, the facility for carrying out the present invention can be made more compact.

Furthermore, according to the present invention, it is enough only to add corresponding consumed amounts of components to the etching solution having the reduced concentrations of the components while recovering the metal ions as metal from the etching solution after the etching, and thus it is possible to carry out a series of said steps in a cyclic manner, completely unnecessitating any separate treatment of waste solution.

The present etching process not only removes unnecessary copper components on a printed circuit board by etching, but is also applicable to a descale step, one of pretreatments for through-hole plating of printed circuit boards or metal etching step.

According to the present invention, metal ions, once formed by etching, can be recovered as metal by electrolysis, and utilized as metal, eliminating metal loss. Thus, the present invention can considerably contribute to saving of resources. Furthermore, the chlorine gas is absorbed in alkali, etc. in cathode compartment 17, for example, forming sodium hypochlorite. Thus, the present invention can be effectively utilized in double or triple manner in cyanide treatment or sterilization of colitis germs of waste water, without any discarding.

According to the present invention, a colorimeter or oxidation-reduction potentiometer can be utilized, and an automatic circulation and regeneration of the etching solution can be carried out by a combination of these meters.

Furthermore, according to the present invention, chlorine is fixed by use of a diaphragm, and rate of electrolytical recovery can be accelerated and the time for recovery step can be also shortened thereby.

What is claimed is:

1. A process for the regeneration of an acidic etching solution containing cupric chloride used in etching of copper comprising the steps of a. electrolyzing a used acidic etching solution containing cupric chloride and cuprous chloride in an electrolytic cell having a cathode compartment separated by a diaphragm from an anode compartment, said used acidic etching solution being contained in said cathode compartment wherein a copper ion concentration of said used acidic etching solution is reduced by deposition of metallic copper on a cathode, a caustic soda solution being contained in said anode compartment wherein chlorine is absorbed by said caustic soda solution, and b. treating an etching solution resulting from an electrolysis according to step (a) with hydrogen peroxide to increase a cupric ion concentration by oxidizing cuprous ions to cupric ions and with hydrochloric acid to increase a chloride ion concentration, said treatment producing a regenerated acidic etching solution containing cupric chloride.

2. A process according to claim 1, further comprising the step of c. etching copper with said acidic etching solution containing cupric chloride resulting from a treatment according to step (b).

3. A process according to claim 1, wherein said regenerated acidic etching solution has a same cupric ion concentration as a concentration of an acidic etching solution containing cupric chloride prior to use in etching of copper.

4. A process according to claim 1, wherein said diaphragm is a ceramic diaphragm.

5. A process according to claim 1, wherein said diaphragm is an asbestos diaphragm.

6. A process according to claim 2, further comprising filtering said used acidic etching solution before electrolysis according to step (a), and filtering said regenerated acidic etching solution before etching according to step (c), said steps (a), (b) and (c) being effected simultaneously.

7. A process according to claim 1, wherein an electrolysis of an acidic etching solution containing cupric chloride and cuprous chloride according to step (a) is effected when an oxidation-reduction potential of said solution is reduced to 400 mV.

* * * * *